US011892233B2

(12) United States Patent
Pierre, Jr.

(10) Patent No.: US 11,892,233 B2
(45) Date of Patent: Feb. 6, 2024

(54) NATURAL GAS LIQUEFACTION BY A HIGH PRESSURE EXPANSION PROCESS

(71) Applicant: ExxonMobil Technology and Engineering Company, Spring, TX (US)

(72) Inventor: Fritz Pierre, Jr., Humble, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 21 days.

(21) Appl. No.: 17/453,537

(22) Filed: Nov. 4, 2021

(65) Prior Publication Data

US 2022/0074652 A1 Mar. 10, 2022

Related U.S. Application Data

(62) Division of application No. 16/112,131, filed on Aug. 24, 2018, now abandoned.

(Continued)

(51) Int. Cl.

*F25J 1/02* (2006.01)
*F25J 1/00* (2006.01)

(52) U.S. Cl.

CPC ..... *F25J 1/0022* (2013.01); *F25J 1/005* (2013.01); *F25J 1/0035* (2013.01); *F25J 1/0037* (2013.01);

(Continued)

(58) Field of Classification Search

CPC ..... F25J 1/0022; F25J 1/0072; F25J 1/0035; F25J 1/0042; F25J 1/0219; F25J 2210/60; F25J 2230/30; F25J 2240/12

See application file for complete search history.

(56) References Cited

U.S. PATENT DOCUMENTS 3,511,058 A 5/1970 Becker
4,141,707 A 2/1979 Springmann (Continued)

FOREIGN PATENT DOCUMENTS

CN 102206520 11/2013
EP 2629035 2/2020
KR 10-2016-0133681 11/2016

OTHER PUBLICATIONS

McLachlan, Greg (2002) "Efficient Operation of LNG From the Oman LNG Project," Shell Global Solutions International B.V., Jan. 1, 2002, pp. 1-8.

(Continued)

*Primary Examiner* — Brian M King

(74) *Attorney, Agent, or Firm* — Vorys, Sater, Seymour and Pease LLP

(57) ABSTRACT

A method and system for liquefying a methane-rich high-pressure feed gas stream using a first heat exchanger zone and a second heat exchanger zone. The feed gas stream is mixed with a refrigerant stream to form a second gas stream, which is compressed, cooled, and directed to a second heat exchanger zone to be additionally cooled below ambient temperature. It is then expanded to a pressure less than 2,000 psia and no greater than the pressure to which the second gas stream was compressed, and then separated into a first expanded refrigerant stream and a chilled gas stream. The first expanded refrigerant stream is expanded and then passed through the first heat exchanger zone such that it has a temperature that is cooler, by at least 5° F., than the highest fluid temperature within the first heat exchanger zone.

10 Claims, 11 Drawing Sheets

Related U.S. Application Data

(60) Provisional application No. 62/565,733, filed on Sep. 29, 2017.

(52) U.S. Cl.
CPC ..... *F25J 1/0042* (2013.01); *F25J 1/0055* (2013.01); *F25J 1/0057* (2013.01); *F25J 1/0072* (2013.01); *F25J 1/0082* (2013.01); *F25J 1/025* (2013.01); *F25J 1/0205* (2013.01); *F25J 1/0207* (2013.01); *F25J 1/0208* (2013.01); *F25J 1/0215* (2013.01); *F25J 1/0219* (2013.01); *F25J 1/0262* (2013.01); *F25J 1/0263* (2013.01); *F25J 1/0265* (2013.01); *F25J 1/0268* (2013.01); *F25J 2205/02* (2013.01); *F25J 2210/60* (2013.01); *F25J 2220/62* (2013.01); *F25J 2230/30* (2013.01); *F25J 2240/12* (2013.01); *F25J 2245/90* (2013.01); *F25J 2270/12* (2013.01); *F25J 2270/90* (2013.01); *F25J 2290/12* (2013.01)

(56) References Cited

U.S. PATENT DOCUMENTS 5,916,260 A * 6/1999 Dubar ..... F25J 1/0204 62/912
6,378,330 B1 4/2002 Minta et al.
6,412,302 B1 7/2002 Foglietta
6,446,465 B1 * 9/2002 Dubar ..... F25J 1/0045 62/612
6,751,985 B2 6/2004 Kimble et al.
8,464,551 B2 6/2013 Roberts et al.
8,656,733 B2 2/2014 Roberts et al.
9,140,490 B2 9/2015 Minta et al.
2009/0217701 A1 * 9/2009 Minta ..... F25J 1/0288 62/612
2010/0107684 A1 5/2010 Minta
2010/0122551 A1 5/2010 Roberts et al.
2010/0186445 A1 * 7/2010 Minta ..... F25J 1/004 62/606
2011/0203313 A1 8/2011 Huda et al.
2012/0036890 A1 2/2012 Kimble et al.
2012/0036892 A1 2/2012 Prosser et al.
2013/0139543 A1 6/2013 Baxter
2014/0026611 A1 1/2014 Darde et al.
2017/0058753 A1 * 3/2017 Lee ..... F16K 31/52416
2018/0258033 A1 * 9/2018 Baharuddin ..... B01J 19/2415
2019/0101327 A1 4/2019 Pierre, Jr.

OTHER PUBLICATIONS

Chang, Ho-Myung et al, (2019) "Thermodynamic Design of Methane Liquefaction System Based on Reversed-Brayton Cycle" Cryogenics, pp. 226-234.

* cited by examiner

NATURAL GAS LIQUEFACTION BY A HIGH PRESSURE EXPANSION PROCESS

CROSS-REFERENCE TO RELATED APPLICATIONS

This application is a divisional of U.S. patent application Ser. No. 16/112,131, filed Aug. 24, 2018, which claims the priority benefit of U.S. Provisional Application No. 62/565,733, filed Sep. 29, 2017, entitled NATURAL GAS LIQUEFACTION BY A HIGH PRESSURE EXPANSION PROCESS, the entirety of which is incorporated by reference herein.

This application is related to U.S. Provisional Application No. 62/565,725, filed Sep. 29, 2017, entitled NATURAL GAS LIQUEFACTION BY A HIGH PRESSURE EXPANSION PROCESS, being commonly owned and filed on an even date herewith, the disclosure of which is incorporated by reference herein in its entirety.

BACKGROUND

Field of Disclosure

The disclosure relates generally to liquefied natural gas (LNG) production. More specifically, the disclosure relates to LNG production at high pressures.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

Because of its clean burning qualities and convenience, natural gas has become widely used in recent years. Many sources of natural gas are located in remote areas, which are great distances from any commercial markets for the gas. Sometimes a pipeline is available for transporting produced natural gas to a commercial market. When pipeline transportation is not feasible, produced natural gas is often processed into liquefied natural gas (LNG) for transport to market.

In the design of an LNG plant, one of the most important considerations is the process for converting the natural gas feed stream into LNG. Currently, the most common liquefaction processes use some form of refrigeration system. Although many refrigeration cycles have been used to liquefy natural gas, the three types most commonly used in LNG plants today are: (1) the "cascade cycle," which uses multiple single component refrigerants in heat exchangers arranged progressively to reduce the temperature of the gas to a liquefaction temperature; (2) the "multi-component refrigeration cycle," which uses a multi-component refrigerant in specially designed exchangers; and (3) the "expander cycle," which expands gas from feed gas pressure to a low pressure with a corresponding reduction in temperature. Most natural gas liquefaction cycles use variations or combinations of these three basic types.

The refrigerants used in liquefaction processes may comprise a mixture of components such as methane, ethane, propane, butane, and nitrogen in multi-component refrigeration cycles. The refrigerants may also be pure substances such as propane, ethylene, or nitrogen in "cascade cycles."

Substantial volumes of these refrigerants with close control of composition are required. Further, such refrigerants may have to be imported and stored, which impose logistics requirements, especially for LNG production in remote locations. Alternatively, some of the components of the refrigerant may be prepared, typically by a distillation process integrated with the liquefaction process.

The use of gas expanders to provide the feed gas cooling, thereby eliminating or reducing the logistical problems of refrigerant handling, is seen in some instances as having advantages over refrigerant-based cooling. The expander system operates on the principle that the refrigerant gas can be allowed to expand through an expansion turbine, thereby performing work and reducing the temperature of the gas. The low temperature gas is then heat exchanged with the feed gas to provide the refrigeration needed. The power obtained from cooling expansions in gas expanders can be used to supply part of the main compression power used in the refrigeration cycle. The typical expander cycle for making LNG operates at the feed gas pressure, typically under about 6,895 kPa (1,000 psia). Supplemental cooling is typically needed to fully liquefy the feed gas and this may be provided by additional refrigerant systems, such as secondary cooling and/or sub-cooling loops. For example, U.S. Pat. Nos. 6,412,302 and 5,916,260 present expander cycles which describe the use of nitrogen as refrigerant in the sub-cooling loop.

Previously proposed expander cycles have all been less efficient thermodynamically, however, than the current natural gas liquefaction cycles based on refrigerant systems. Expander cycles have therefore not offered any installed cost advantage to date, and liquefaction cycles involving refrigerants are still the preferred option for natural gas liquefaction.

Because expander cycles result in a high recycle gas stream flow rate and high inefficiency for the primary cooling (warm) stage, gas expanders have typically been used to further cool feed gas after it has been pre-cooled to temperatures well below −20° C. using an external refrigerant in a closed cycle, for example. Thus, a common factor in most proposed expander cycles is the requirement for a second, external refrigeration cycle to pre-cool the gas before the gas enters the expander. Such a combined external refrigeration cycle and expander cycle is sometimes referred to as a "hybrid cycle." While such refrigerant-based pre-cooling eliminates a major source of inefficiency in the use of expanders, it significantly reduces the benefits of the expander cycle, namely the elimination of external refrigerants.

U.S. Patent Application US2009/0217701 introduced the concept of using high pressure within the primary cooling loop to eliminate the need for external refrigerant and improve efficiency, at least comparable to that of refrigerant-based cycles currently in use. The high pressure expander process (HPXP), disclosed in U.S. Patent Application US2009/0217701, is an expander cycle which uses high pressure expanders in a manner distinguishing from other expander cycles. A portion of the feed gas stream may be extracted and used as the refrigerant in either an open loop or closed loop refrigeration cycle to cool the feed gas stream below its critical temperature. Alternatively, a portion of LNG boil-off gas may be extracted and used as the refrigerant in a closed loop refrigeration cycle to cool the feed gas stream below its critical temperature. This refrigeration cycle is referred to as the primary cooling loop. The primary cooling loop is followed by a sub-cooling loop which acts to further cool the feed gas. Within the primary cooling loop, the refrigerant is compressed to a pressure greater than 1,500 psia, or more preferably, to a pressure of approximately 3,000 psia. The refrigerant is then cooled against an ambient cooling medium (air or water) prior to being near isentropically expanded to provide the cold refrigerant needed to liquefy the feed gas.

FIG. 1 depicts an example of a known HPXP liquefaction process 100, and is similar to one or more processes disclosed in U.S Patent Application US2009/0217701. In FIG. 1, an expander loop 102 (i.e., an expander cycle) and a sub-cooling loop 104 are used. Feed gas stream 106 enters the HPXP liquefaction process at a pressure less than about 1,200 psia, or less than about 1,100 psia, or less than about 1,000 psia, or less than about 900 psia, or less than about 800 psia, or less than about 700 psia, or less than about 600 psia. Typically, the pressure of feed gas stream 106 will be about 800 psia. Feed gas stream 106 generally comprises natural gas that has been treated to remove contaminants using processes and equipment that are well known in the art.

In the expander loop 102, a compression unit 108 compresses a refrigerant stream 109 (which may be a treated gas stream) to a pressure greater than or equal to about 1,500 psia, thus providing a compressed refrigerant stream 110. Alternatively, the refrigerant stream 109 may be compressed to a pressure greater than or equal to about 1,600 psia, or greater than or equal to about 1,700 psia, or greater than or equal to about 1,800 psia, or greater than or equal to about 1,900 psia, or greater than or equal to about 2,000 psia, or greater than or equal to about 2,500 psia, or greater than or equal to about 3,000 psia, thus providing compressed refrigerant stream 110. After exiting compression unit 108, compressed refrigerant stream 110 is passed to a cooler 112 where it is cooled by indirect heat exchange with a suitable cooling fluid to provide a compressed, cooled refrigerant stream 114. Cooler 112 may be of the type that provides water or air as the cooling fluid, although any type of cooler can be used. The temperature of the compressed, cooled refrigerant stream 114 depends on the ambient conditions and the cooling medium used, and is typically from about 35° F. to about 105° F. Compressed, cooled refrigerant stream 114 is then passed to an expander 116 where it is expanded and consequently cooled to form an expanded refrigerant stream 118. Expander 116 is a work-expansion device, such as a gas expander, which produces work that may be extracted and used for compression. Expanded refrigerant stream 118 is passed to a first heat exchanger 120, and provides at least part of the refrigeration duty for first heat exchanger 120. Upon exiting first heat exchanger 120, expanded refrigerant stream 118 is fed to a compression unit 122 for pressurization to form refrigerant stream 109.

Feed gas stream 106 flows through first heat exchanger 120 where it is cooled, at least in part, by indirect heat exchange with expanded refrigerant stream 118. After exiting first heat exchanger 120, the feed gas stream 106 is passed to a second heat exchanger 124. The principal function of second heat exchanger 124 is to sub-cool the feed gas stream. Thus, in second heat exchanger 124 the feed gas stream 106 is sub-cooled by sub-cooling loop 104 (described below) to produce sub-cooled stream 126. Sub-cooled stream 126 is then expanded to a lower pressure in expander 128 to form a liquid fraction and a remaining vapor fraction. Expander 128 may be any pressure reducing device, including, but not limited to a valve, control valve, Joule Thompson valve, Venturi device, liquid expander, hydraulic turbine, and the like. The sub-cooled stream 126, which is now at a lower pressure and partially liquefied, is passed to a surge tank 130 where the liquefied fraction 132 is withdrawn from the process as an LNG stream 134, which has a temperature corresponding to the bubble point pressure. The remaining vapor fraction (flash vapor) stream 136 may be used as fuel to power the compressor units.

In sub-cooling loop 104, an expanded sub-cooling refrigerant stream 138 (preferably comprising nitrogen) is discharged from an expander 140 and drawn through second and first heat exchangers 124, 120. Expanded sub-cooling refrigerant stream 138 is then sent to a compression unit 142 where it is re-compressed to a higher pressure and warmed. After exiting compression unit 142, the re-compressed sub-cooling refrigerant stream 144 is cooled in a cooler 146, which can be of the same type as cooler 112, although any type of cooler may be used. After cooling, the re-compressed sub-cooling refrigerant stream is passed to first heat exchanger 120 where it is further cooled by indirect heat exchange with expanded refrigerant stream 118 and expanded sub-cooling refrigerant stream 138. After exiting first heat exchanger 120, the re-compressed and cooled sub-cooling refrigerant stream is expanded through expander 140 to provide a cooled stream which is then passed through second heat exchanger 124 to sub-cool the portion of the feed gas stream to be finally expanded to produce LNG.

U.S. Patent Application US2010/0107684 disclosed an improvement to the performance of the HPXP through the discovery that adding external cooling to further cool the compressed refrigerant to temperatures below ambient conditions provides significant advantages which in certain situations justifies the added equipment associated with external cooling. The HPXP embodiments described in the aforementioned patent applications perform comparably to alternative mixed external refrigerant LNG production processes such as single mixed refrigerant processes. However, there remains a need to further improve the efficiency of the HPXP as well as overall train capacity. There remains a particular need to improve the efficiency of the HPXP in cases where the feed gas pressure is less than 1,200 psia.

U.S. Patent Application 2010/0186445 disclosed the incorporation of feed compression up to 4,500 psia to the HPXP. Compressing the feed gas prior to liquefying the gas in the HPXP's primary cooling loop has the advantage of increasing the overall process efficiency. For a given production rate, this also has the advantage of significantly reducing the required flow rate of the refrigerant within the primary cooling loop which enables the use of compact equipment, which is particularly attractive for floating LNG applications. Furthermore, feed compression provides a means of increasing the LNG production of an HPXP train by more than 30% for a fixed amount of power going to the primary cooling and sub-cooling loops. This flexibility in production rate is again particularly attractive for floating LNG applications where there are more restrictions than land based applications in matching the choice of refrigerant loop drivers with desired production rates. Although liquefying the feed gas at high pressures has advantages, it was found that for liquefaction pressures greater than 1,500 psia the choice of suitable cryogenic heat exchangers for the primary cooling and sub-cooling loops were limited to options significantly high in cost, weight and with reduced fluid processing capabilities. For example, the use of printed circuit heat exchangers, which are capable of operating at pressures greater than 4,500 psia, was shown to significantly increase project cost compared to the more widely sourced brazed aluminum heat exchanger type where proven operating pressures are less than 1,500 psia. This significant increase in cost may limit the practical application of feed compression to up to 1,500 psia. Thus, there remains a need to further improve the HPXP without requiring feed compression or feed compression greater the 1,500 psia. Additionally, there remains an additional need to allow the use of significant feed compression with HPXP without requiring the use of high-cost main cryogenic heat exchangers such as printed circuit heat exchangers.

SUMMARY

The present disclosure provides a method for liquefying a feed gas stream rich in methane, where the method comprises the following steps: providing the feed gas stream at a pressure less than 1,200 psia; providing a refrigerant stream at near the same pressure of the feed gas stream; mixing the feed gas stream with the refrigerant stream to form a second gas stream; compressing the second gas stream to a pressure of at least 1,500 psia to form a compressed second gas stream; cooling the compressed second gas stream by indirect heat exchange with ambient temperature air or water, to form a compressed, cooled second gas stream; directing the compressed, cooled second gas stream to a second heat exchanger zone, to additionally cool the compressed, cooled second gas stream below ambient temperature, thereby producing a compressed, additionally cooled second gas stream; expanding the compressed, additionally cooled second gas stream in at least one work producing expander to a pressure that is less than 2,000 psia and no greater than the pressure to which the second gas stream was compressed, to thereby form an expanded, cooled second gas stream; separating the expanded, cooled second gas stream into a first expanded refrigerant stream and a chilled gas stream; expanding the first expanded refrigerant stream in at least one work producing expander, thereby producing a second expanded refrigerant stream; passing the second expanded refrigerant stream through a first heat exchanger zone to form a first warm refrigerant stream such that the first warm refrigerant stream has a temperature that is cooler, by at least 5° F., than the highest fluid temperature within the first heat exchanger zone; passing the chilled gas stream through the first heat exchanger zone to cool at least part of the chilled gas stream by indirect heat exchange with the second expanded refrigerant stream, thereby forming a liquefied gas stream; directing the first warm refrigerant stream to the second heat exchanger zone to cool by indirect heat exchange the compressed, cooled second gas stream, thereby forming a second warm refrigerant stream; and compressing the second warm refrigerant stream to produce the refrigerant stream.

The disclosure also provides a system for liquefying a feed gas stream rich in methane, the feed gas stream having a pressure of less than 1,200 psia, the system including a first heat exchanger zone and a second heat exchanger zone: The system comprises: a refrigerant stream having a pressure near the same pressure of the feed gas stream; a compressor that compresses the combined refrigerant stream and feed gas stream to a pressure of at least 1,500 psia, thereby forming a compressed second gas stream; a cooler that cools the compressed second gas stream by indirect heat exchange with ambient temperature air or water, to thereby form a compressed, cooled second gas stream; wherein the compressed, cooled second gas stream is directed to the second heat exchanger zone, to additionally cool the compressed, cooled second gas stream below ambient temperature, thereby producing a compressed, additionally cooled second gas stream; at least one work producing expander that expands the compressed, additionally cooled second gas stream to a pressure that is less than 2,000 psia and no greater than the pressure to which the second gas stream was compressed, to thereby form an expanded, cooled second gas stream; wherein the expanded, cooled second gas stream is separated into a first expanded refrigerant stream and a chilled gas stream; an additional at least one work producing expander that expands the first expanded refrigerant stream, thereby producing a second expanded refrigerant stream; wherein the second expanded refrigerant stream is passed through the first heat exchanger zone to form a first warm refrigerant stream such that the first warm refrigerant stream has a temperature that is cooler, by at least 5° F., than the highest fluid temperature within the first heat exchanger zone; wherein the chilled gas stream is passed through the first heat exchanger zone to cool at least part of the chilled gas stream by indirect heat exchange with the second expanded refrigerant stream, thereby forming a liquefied gas stream; wherein the first warm refrigerant stream is directed to the second heat exchanger zone to cool by indirect heat exchange the compressed, cooled second gas stream, thereby forming a second warm refrigerant stream; and an additional compressor that compresses the second warm refrigerant stream to produce the refrigerant stream.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
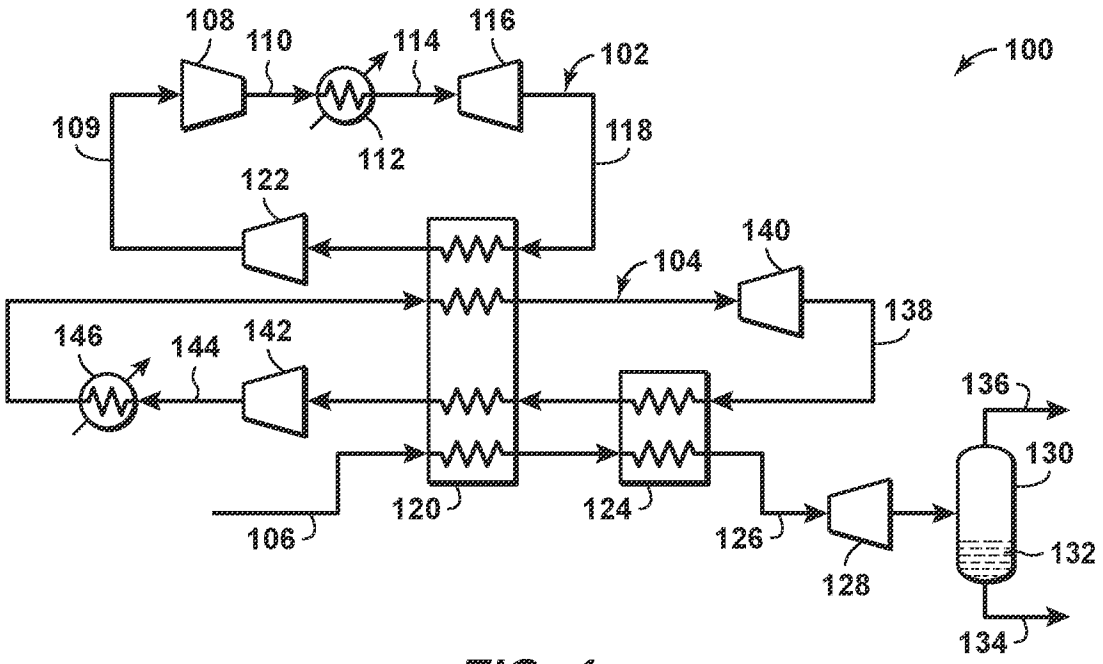
FIG. 1 (Prior Art)
FIG. 1 is a schematic diagram of a system for LNG production according to known principles.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure. The term "near" is intended to mean within 2%, or within 5%, or within 10%, of a number or amount.

As used herein, the term "compression unit" means any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

"Exemplary" is used exclusively herein to mean "serving as an example, instance, or illustration." Any embodiment or aspect described herein as "exemplary" is not to be construed as preferred or advantageous over other embodiments.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

As used herein, "heat exchange area" means any one type or combination of similar or different types of equipment known in the art for facilitating heat transfer. Thus, a "heat exchange area" may be contained within a single piece of equipment, or it may comprise areas contained in a plurality of equipment pieces. Conversely, multiple heat exchange areas may be contained in a single piece of equipment.

A "hydrocarbon" is an organic compound that primarily includes the elements hydrogen and carbon, although nitrogen, sulfur, oxygen, metals, or any number of other elements can be present in small amounts. As used herein, hydrocarbons generally refer to components found in natural gas, oil, or chemical processing facilities.

As used herein, the terms "loop" and "cycle" are used interchangeably.

As used herein, "natural gas" means a gaseous feedstock suitable for manufacturing LNG, where the feedstock is a methane-rich gas containing methane (CO as a major component. Natural gas may include gas obtained from a crude oil well (associated gas) or from a gas well (non-associated gas).

The disclosure describes a process/method and system for liquefying natural gas and other methane-rich gas streams to produce liquefied natural gas (LNG) and/or other liquefied methane-rich gases. In one or more aspects of the disclosure, the primary cooling loop is segmented into two heat exchanger zones. Within the first heat exchanger zone, the primary cooling loop refrigerant is used to liquefy the feed gas. Within the second heat exchanger zone, all or a portion of the primary cooling loop refrigerant is used to cool the high pressure primary cooling loop refrigerant prior to expansion of the refrigerant. The first heat exchanger zone is physically separate from second heat exchanger zone. Additionally, the heat exchanger type of the first heat exchanger zone is different from the heat exchanger type of the second heat exchanger zone. One advantage of having two separate heat exchanger zones is that the types of heat exchangers in the two zones can be different from each other. As a non-limiting example, the type of heat exchanger(s) used in the first exchanger zone may include a brazed aluminum heat exchanger, and the type of heat exchanger(s) used in the second heat exchanger zone may be include a printed circuit heat exchanger. It is in the first exchanger zone where more the 90% of the heat transfer needed to liquefy the feed gas occurs. Using the less expensive brazed aluminum heat exchanger here reduces project cost. The significantly more expensive printed circuit heat exchanger may be used in the second heat exchanger zone because it can operate at the required 3,000 psia pressure of the high pressure refrigerant. The use of a printed circuit heat exchanger in the second heat exchanger zone does not significantly impact overall project cost since it is a relatively small heat exchanger. This is because the heat transfer duty within the second heat exchanger zone is significantly smaller than that of the first heat exchanger zone. Both heat exchanger zones may comprise multiple heat exchangers.

In an aspect, a method for liquefying a gas stream, particularly one rich in methane, includes: (a) providing the gas stream at a pressure less than 1,200 psia; (b) providing a compressed refrigerant with a pressure greater than or equal to 1,500 psia; (c) cooling the compressed refrigerant by indirect heat exchange with an ambient temperature air or water to produce a compressed, cooled refrigerant; (d) directing the compressed, cooled refrigerant to a second heat exchanger zone to additionally cool the compressed, cooled refrigerant below ambient temperature to produce a compressed, additionally cooled refrigerant; (e) expanding the compressed, additionally cooled refrigerant in at least one work producing expander thereby producing an expanded, cooled refrigerant; (f) passing the expanded, cooled refrigerant through a first heat exchanger zone to form a first warm refrigerant, whereby the first warm refrigerant has a temperature that is cooler, by at least 5° F., than the highest fluid temperature within the first heat exchanger zone, and whereby the heat exchanger type of the first heat exchanger zone is different from the heat exchanger type of the second heat exchanger zone; (g) passing the gas stream through the first heat exchanger zone to cool at least part of the gas stream by indirect heat exchange with the expanded, cooled refrigerant, thereby forming a liquefied gas stream; (h) directing a least a portion of the first warm refrigerant to the second heat exchanger zone to cool by indirect heat exchange the compressed, cooled refrigerant thereby forming a second warm refrigerant; and (i) compressing the second warm refrigerant to produce the compressed refrigerant.

In another aspect, a method for liquefying a gas stream includes: (a) providing the gas stream at a pressure less than 1,200 psia; (b) compressing the gas stream to a pressure of at least 1,500 psia to form a compressed gas stream; (c) cooling the compressed gas stream by indirect heat exchange with an ambient temperature air or water to form a compressed, cooled gas stream; (d) expanding the compressed, cooled gas stream in at least one work producing expander to a pressure that is less than 2,000 psia and no greater than the pressure to which the gas stream was compressed, to thereby form a chilled gas stream; (e) providing a compressed refrigerant with a pressure greater than or equal to 1,500 psia; (f) cooling the compressed refrigerant by indirect heat exchange with an ambient temperature air or water to produce a compressed, cooled refrigerant; (g) directing the compressed, cooled refrigerant to a second heat exchanger zone to additionally cool the compressed, cooled refrigerant below ambient temperature to produce a compressed, additionally cooled refrigerant; (h) expanding the compressed, additionally cooled refrigerant in at least one work producing expander thereby producing an expanded, cooled refrigerant; (i) passing the expanded, cooled refrigerant through a first heat exchanger zone to form a first warm refrigerant, whereby the first warm refrigerant has a temperature that is cooler, by at least 5° F., than the highest fluid temperature within the first heat exchanger zone, and whereby the heat exchanger type of the first heat exchanger zone is different from the heat exchanger type of the second heat exchanger zone; (j) passing the chilled gas stream through the first heat exchanger zone to cool at least part of the chilled gas stream by indirect heat exchange with the expanded, cooled refrigerant, thereby forming a liquefied gas stream; (k) directing the first warm refrigerant to the second heat exchanger zone to cool by indirect heat exchange the compressed, cooled refrigerant, thereby forming a second warm refrigerant; and (l) compressing the second warm refrigerant to produce the compressed refrigerant.

In another aspect, a method for liquefying a gas stream includes: (a) providing the gas stream at a pressure less than 1,200 psia; (b) providing a refrigerant stream at near the same pressure of the gas stream; (c) mixing the gas stream with the refrigerant stream to form a second gas stream; (d) compressing the second gas stream to a pressure of at least 1,500 psia to form a compressed second gas stream; (e) cooling the compressed second gas stream by indirect heat exchange with an ambient temperature air or water to form a compressed, cooled second gas stream; (f) directing the compressed, cooled second gas stream to a second heat exchanger zone to additionally cool the compressed, cooled second gas stream below ambient temperature to produce a compressed, additionally cooled second gas stream; (g) expanding the compressed, additionally cooled second gas stream in at least one work producing expander to a pressure that is less than 2,000 psia and no greater than the pressure to which the second gas stream was compressed, to thereby form an expanded, cooled second gas stream; (h) separating the expanded, cooled second gas stream into a first expanded refrigerant and a chilled gas stream; (i) expanding the first expanded refrigerant in at least one work producing expander, thereby producing a second expanded refrigerant; (j) passing the second expanded refrigerant through a first heat exchanger zone to form a first warm refrigerant, whereby the first warm refrigerant has a temperature that is cooler, by at least 5° F., than the highest fluid temperature within the first heat exchanger zone, and whereby the heat exchanger type of the first heat exchanger zone is different from the heat exchanger type of the second heat exchanger zone; (k) passing the chilled gas stream through the first heat exchanger zone to cool at least part of the chilled gas stream by indirect heat exchange with the second expanded refrigerant, thereby forming a liquefied gas stream; (l) directing the first warm refrigerant to the second heat exchanger zone to cool by indirect heat exchange the compressed, cooled second gas stream, thereby forming a second warm refrigerant; and (m) compressing the second warm refrigerant to produce the refrigerant stream.

Aspects of the disclosure may include the additional steps of compressing the gas stream to a pressure no greater than 1,600 psia and then cooling the compressed gas stream by indirect heat exchange with an ambient temperature air or water prior to directing the gas stream to the first heat exchanger zone. Aspects of the disclosure may also include the additional steps of cooling the gas stream to a temperature below the ambient by indirect heat exchange within an external cooling unit prior to directing the gas stream to the first heat exchanger zone. Aspects of the disclosure may also include the additional steps of cooling the compressed, cooled refrigerant to a temperature below the ambient temperature by indirect heat exchange with an external cooling unit prior to directing the compressed, cooled refrigerant to the second heat exchanger zone. These described additional steps may be employed singularly or in combination with each other.

Aspects of the disclosure have several advantages over the known liquefaction processes, in which feed compression is required to significantly improve the efficiency of the HPXP. In contrast, the efficiency of the disclosed aspects is more than 16% greater than the efficiency for a comparable configuration according to known liquefaction processes. Aspects of the disclosure may have the additional advantage of allowing significant feed compression (greater than 1,500 psia) without requiring the use of high cost main cryogenic heat exchangers for the first heat exchanger zone. Feed compression by the disclosed method may provide a means of increasing the LNG production of an HPXP train by more than 25% for a fixed amount of power going to the primary cooling and sub-cooling loops. Aspects of the disclosure may also have the advantage of combining the compression service of the feed gas and some of that of the primary cooling loop to reduce equipment count. Such an embodiment provides a highly efficient and compact configuration suitable for small scale LNG applications.

Figure 2:
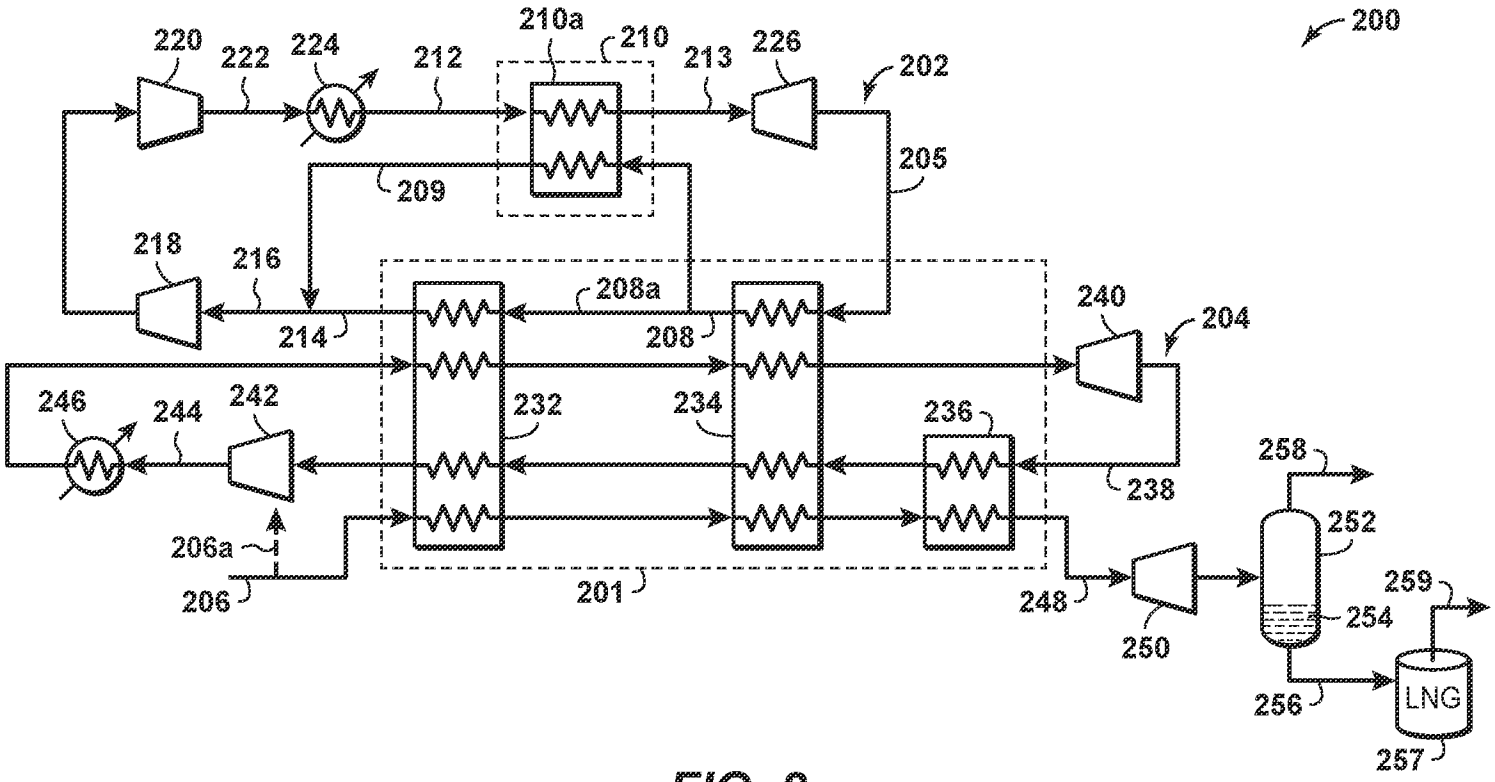
FIG. 2 is a schematic diagram of a system for LNG production according to disclosed aspects.

FIG. 2 is a schematic diagram that illustrates a liquefaction system 200 according to an aspect of the disclosure. The liquefaction system 200 includes a primary cooling loop 202, which may also be called an expander loop. The liquefaction system also includes a sub-cooling loop 204, which is a closed refrigeration loop preferably charged with nitrogen as the sub-cooling refrigerant. Within the primary cooling loop 202, an expanded, cooled refrigerant stream 205 is directed to a first heat exchanger zone 201 where it exchanges heat with a feed gas stream 206 to form a first warm refrigerant stream 208. A portion of the first warm refrigerant 208 is directed to a second heat exchanger zone 210 where, in one or more heat exchangers 210*a*, it exchanges heat with a compressed, cooled refrigerant stream 212 to additionally cool the compressed, cooled refrigerant stream and form a second warm refrigerant stream 209 and a compressed, additionally cooled refrigerant stream 213. The one or more heat exchangers 210*a* may be of a printed circuit heat exchanger type, a shell and tube heat exchanger type, or a combination thereof. The heat exchanger types within the second heat exchanger zone may have a design pressure of greater than 1,500 psia, or more preferably, a design pressure of greater than 2,000 psia, or more preferably, a design pressure of greater than 3,000 psia.

The portion of the first warm refrigerant stream 208 directed to the second heat exchanger zone 210 has a temperature that is cooler by at least 5° F., or more preferably, cooler by at least 10° F., or more preferably, cooler by at least 15° F., than the highest fluid temperature within the first heat exchanger zone 201. The portion of the first warm refrigerant stream 208 that may remain within the first heat exchanger zone (as shown by reference number 208*a*) further exchanges heat with the feed gas stream to form a third warm refrigerant stream 214. The second warm refrigerant stream 209 from the second heat exchanger zone 210 may be combined with the third warm refrigerant stream 214 from the first heat exchanger zone 201 to produce a fourth warm refrigerant stream 216. The fourth warm refrigerant stream is compressed in one or more compression units 218, 220 to a pressure greater than 1,500 psia, or more preferably, to a pressure of approximately 3,000 psia, to form a compressed refrigerant stream 222. The compressed refrigerant stream 222 is then cooled against an ambient cooling medium (air or water) in a cooler 224 to produce the compressed, cooled refrigerant stream 212. Cooler 224 may be similar to cooler 112 as previously described. The compressed, additionally cooled refrigerant stream 213 is near isentropically expanded in an expander 226 to produce the expanded, cooled refrigerant stream 205. Expander 226 may be a work-expansion device, such as a gas expander, which produces work that may be extracted and used for compression.

The first heat exchanger zone 201 may include a plurality of heat exchanger devices, and in the aspects shown in FIG. 2, the first heat exchanger zone includes first and second main heat exchangers 232, 234, and a sub-cooling heat exchanger 236 exchange heat with the expanded, cooled refrigerant 205. These heat exchangers may be of a brazed aluminum heat exchanger type, a plate fin heat exchanger type, a spiral wound heat exchanger type, or a combination thereof. Within the sub-cooling loop 204, an expanded sub-cooling refrigerant stream 238 (preferably comprising nitrogen) is discharged from an expander 240 and drawn through sub-cooling heat exchanger 236 and second and first main heat exchangers 234, 232. Expanded sub-cooling refrigerant stream 238 is then sent to a compression unit 242 where it is re-compressed to a higher pressure and warmed. After exiting compression unit 242, the re-compressed sub-cooling refrigerant stream 244 is cooled in a cooler 246, which can be of the same type as cooler 224, although any type of cooler may be used. After cooling, the re-compressed sub-cooling refrigerant stream is passed through first and second main heat exchangers 232, 234 where it is further cooled by indirect heat exchange with part or all of the warm refrigerant stream 208 and expanded sub-cooling refrigerant stream 238. After exiting first heat exchange area 201, the re-compressed and cooled sub-cooling refrigerant stream is expanded through expander 240 to provide the expanded sub-cooled refrigerant stream 238 that is re-cycled through the first heat exchanger zone as described herein. In this manner, the feed gas stream 206 is cooled, liquefied and sub-cooled in the first heat exchanger zone 201 to produce a sub-cooled gas stream 248. Sub-cooled gas stream 248 is then expanded to a lower pressure in expander 250 to form a liquid fraction and a remaining vapor fraction. Expander 250 may be any pressure reducing device, including but not limited to a valve, control valve, Joule Thompson valve, Venturi device, liquid expander, hydraulic turbine, and the like. The sub-cooled stream 248, which is now at a lower pressure and partially liquefied, is passed to a surge tank 252 where the liquefied fraction 254 is withdrawn from the process as an LNG stream 256, which has a temperature corresponding to the bubble point pressure. The remaining vapor fraction (flash vapor) stream 258 may be used as fuel to power the compressor units.

Figure 3:
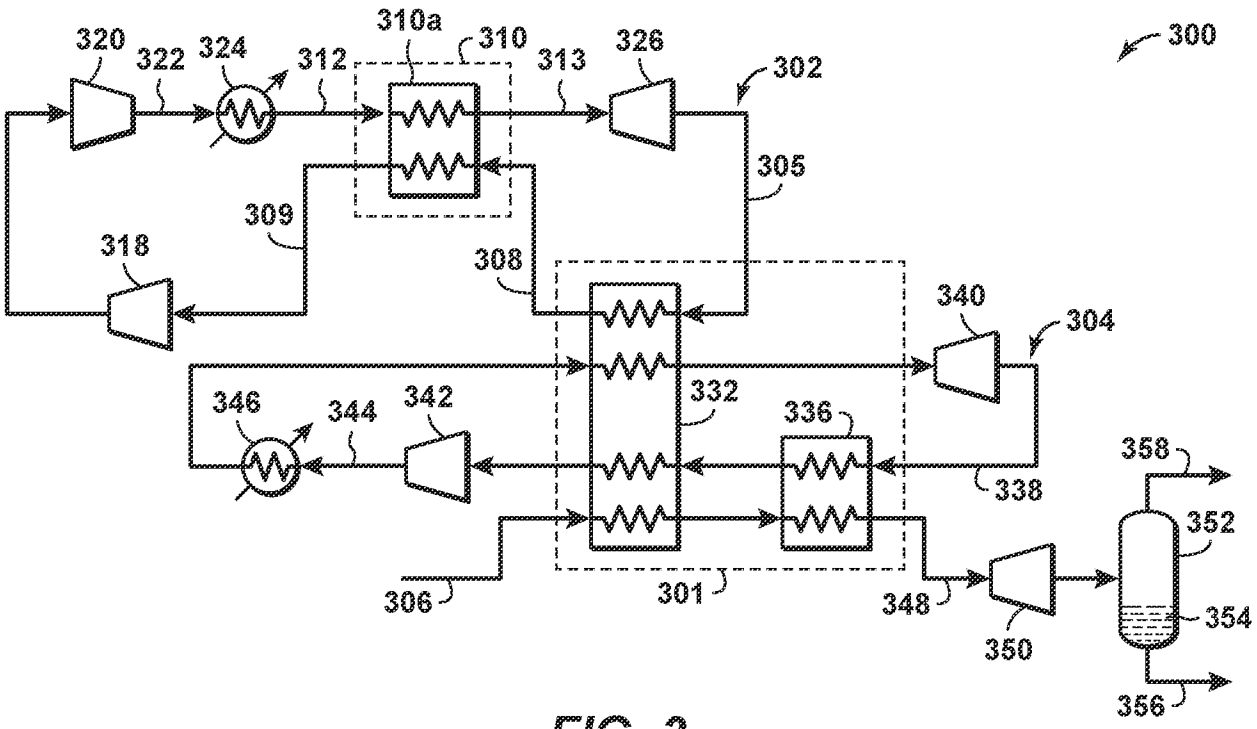
FIG. 3 is a schematic diagram of a system for LNG production according to disclosed aspects.

FIG. 3 is a schematic diagram that illustrates a liquefaction system 300 according to another aspect of the disclosure. Liquefaction system 300 is similar to liquefaction system 200 and for the sake of brevity similarly depicted or numbered components may not be further described. Liquefaction system 300 includes a primary cooling loop 302 and a sub-cooling loop 304. Liquefaction system 300 also includes first and second heat exchanger zones 301, 310. In contrast with liquefaction system 200, all of the first warm refrigerant 308 is directed to the second heat exchanger zone 310 where, in one or more heat exchangers 310*a*, it exchanges heat with a compressed, cooled refrigerant stream 312 to form a second warm refrigerant 309.

The first warm refrigerant stream 308 has a temperature that is cooler by at least 5° F., or more preferably, cooler by at least 10° F., or more preferably, cooler by at least 15° F., than the highest fluid temperature within the first heat exchanger zone. The second warm refrigerant stream 309 may be compressed in one or more compressors 318, 320 to a pressure greater than 1,500 psia, or more preferably, to a pressure of approximately 3,000 psia, to thereby form a compressed refrigerant stream 322. The compressed refrigerant stream 322 is then cooled against an ambient cooling medium (air or water) to produce the compressed, cooled refrigerant stream 312 that is directed to the second heat exchanger zone 310. The compressed, additionally cooled refrigerant stream 313 is near isentropically expanded in an expander 326 to produce the expanded, cooled refrigerant stream 305.

The feed gas stream 306 is directed through the first heat exchange area 301 that includes a main heat exchanger 332 and a sub-cooling heat exchanger 336. The number of main heat exchangers in first heat exchanger zone 301 may be reduced since all of the first warm refrigerant 308 is directed to the second heat exchanger zone 310. Within the sub-cooling loop 304, an expanded sub-cooling refrigerant stream 338 (preferably comprising nitrogen) is discharged from an expander 340 and drawn through sub-cooling heat exchanger 336 and main heat exchanger 332. Expanded sub-cooling refrigerant stream 338 is then sent to a compression unit 342 where it is re-compressed to a higher pressure and warmed. After exiting compression unit 342, the re-compressed sub-cooling refrigerant stream 344 is cooled in a cooler 346, which can be of the same type as cooler 324, although any type of cooler may be used. After cooling, the re-compressed sub-cooling refrigerant stream is passed through main heat exchanger 232 where it is further cooled by indirect heat exchange with part or all of the expanded, cooled refrigerant stream 305 and expanded sub-cooling refrigerant stream 338. After exiting first heat exchange area 301, the re-compressed and cooled sub-cooling refrigerant stream is expanded through expander 340 to provide the expanded sub-cooled refrigerant stream 338 that is re-cycled through the first heat exchange area as described herein. In this manner, the feed gas stream 306 is cooled, liquefied and sub-cooled in the first heat exchanger zone 301 to produce a sub-cooled gas stream 348. Sub-cooled gas stream 348 is then expanded to a lower pressure in expander 350 to form a liquid fraction and a remaining vapor fraction. Expander 350 may be any pressure reducing device, including but not limited to a valve, control valve, Joule Thompson valve, Venturi device, liquid expander, hydraulic turbine, and the like. The sub-cooled stream 348, which is now at a lower pressure and partially liquefied, is passed to a surge tank 352 where the liquefied fraction 354 is withdrawn from the process as an LNG stream 356, which has a temperature corresponding to the bubble point pressure. The remaining vapor fraction (flash vapor) stream 358 may be used as fuel to power the compressor units.

Figure 4:
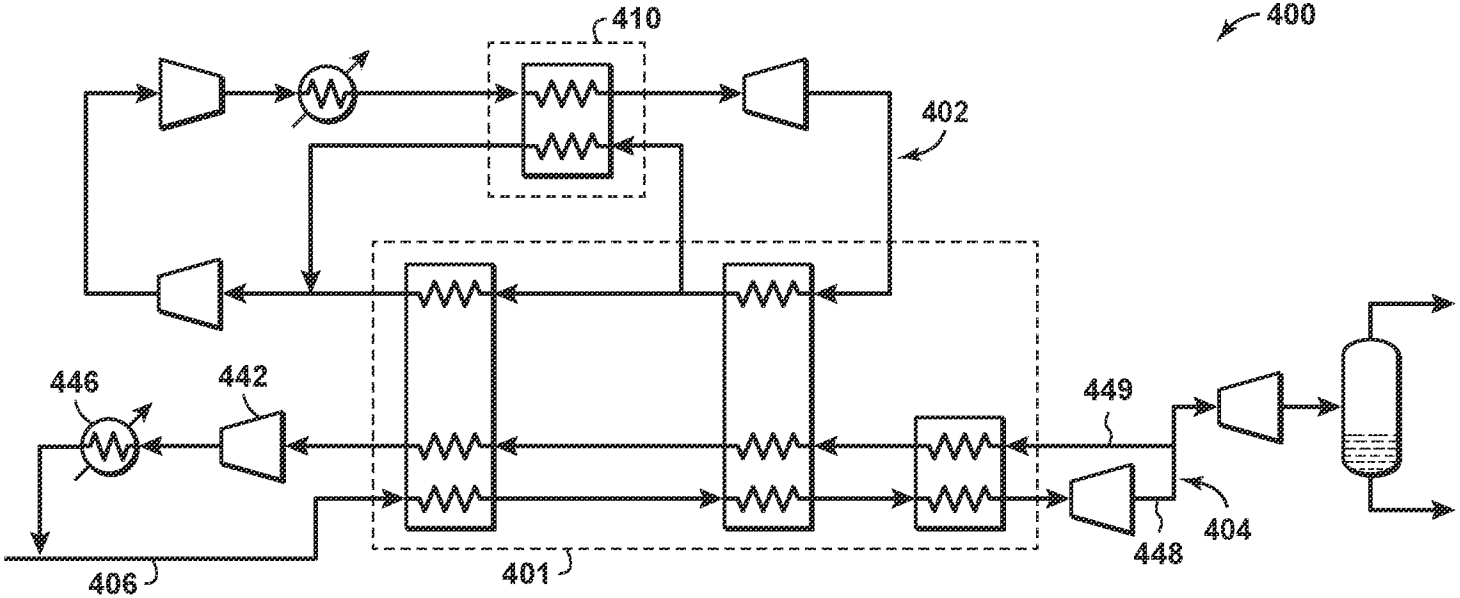
FIG. 4 is a schematic diagram of a system for LNG production according to disclosed aspects.

FIG. 4 is a schematic diagram that illustrates a liquefaction system 400 according to another aspect of the disclosure. Liquefaction system 400 is similar to liquefaction system 200, and for the sake of brevity similarly depicted or numbered components may not be further described. Liquefaction system 400 includes a primary cooling loop 402 and a sub-cooling loop 404. Liquefaction system 400 also includes first and second heat exchanger zones 401, 410. In liquefaction system 400, the sub-cooling loop 404 is an open refrigeration loop where a portion 449 of the expanded, sub-cooled gas stream 448 is recycled and used as the sub-cooling refrigerant stream. Specifically, the portion 449 of the expanded, sub-cooled gas stream is directed through the first heat exchanger zone 401 as previously described before being compressed in a compressor 442, cooled in a cooler 446, and re-inserted into the feed gas stream 406. This sub-cooling refrigerant stream may be one stream, as shown, or may comprise multiple streams at different pressures: for example, a portion of the expanded, sub-cooling gas stream—not to exceed 50% thereof—may be diverted and pass through one or more pressure reduction valves to reduce its pressure to a range of about 30 to 300 psia, to thereby produce one or more reduced pressure gas streams. The reduced pressure gas streams may then be passed through the first heat exchanger zone as the sub-cooling refrigerant. Having multiple streams improves the efficiency of the sub-cooling process. Alternatively, this sub-cooling loop may be configured to be a closed refrigeration loop.

Figure 5:
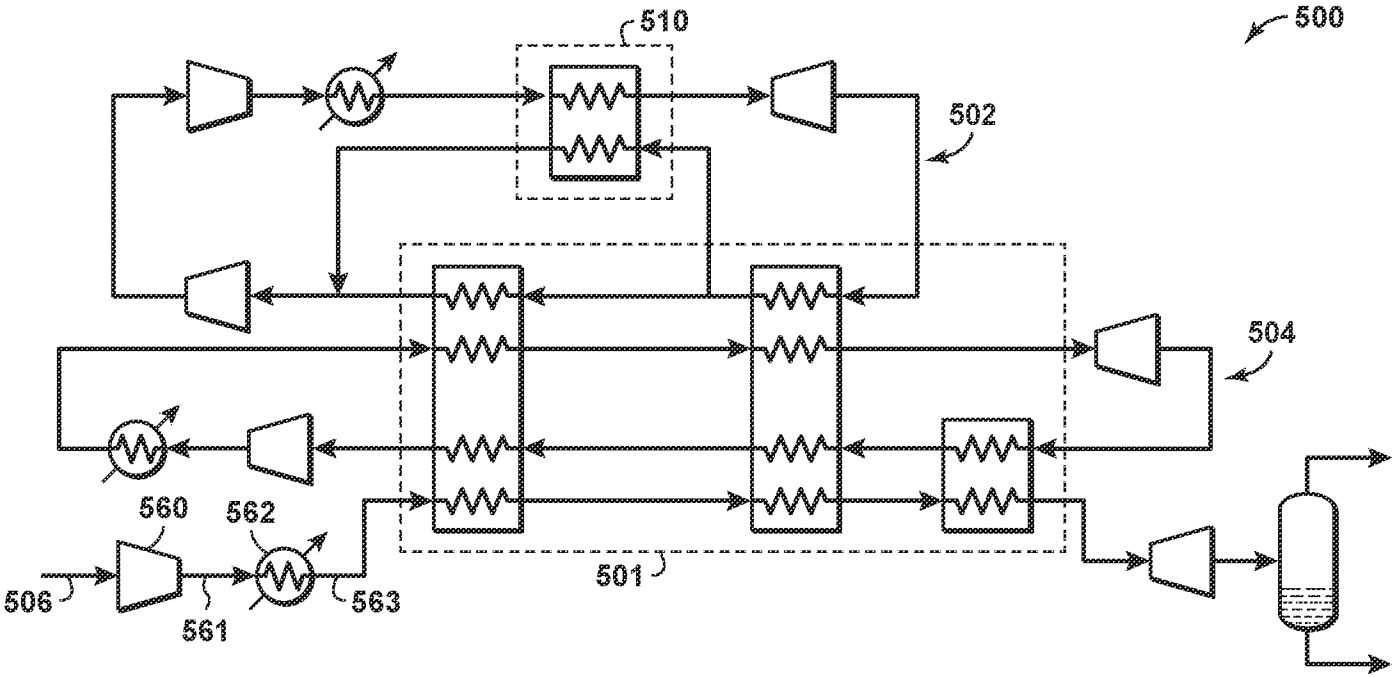
FIG. 5 is a schematic diagram of a system for LNG production according to disclosed aspects.

FIG. 5 is a schematic diagram that illustrates a liquefaction system 500 according to another aspect of the disclosure. Liquefaction system 500 is similar to liquefaction system 200 and for the sake of brevity similarly depicted or numbered components may not be further described. Liquefaction system 500 includes a primary cooling loop 502 and a sub-cooling loop 504. Liquefaction system 500 also includes first and second heat exchanger zones 501, 510. Liquefaction system 500 stream includes the additional steps of compressing the feed gas stream 506 in a compressor 560 and then, using a cooler 562, cooling the compressed feed gas 561 with ambient air or water to produce a cooled, compressed feed gas stream 563. Feed gas compression may be used to improve the overall efficiency of the liquefaction process and increase LNG production.

Figure 6:
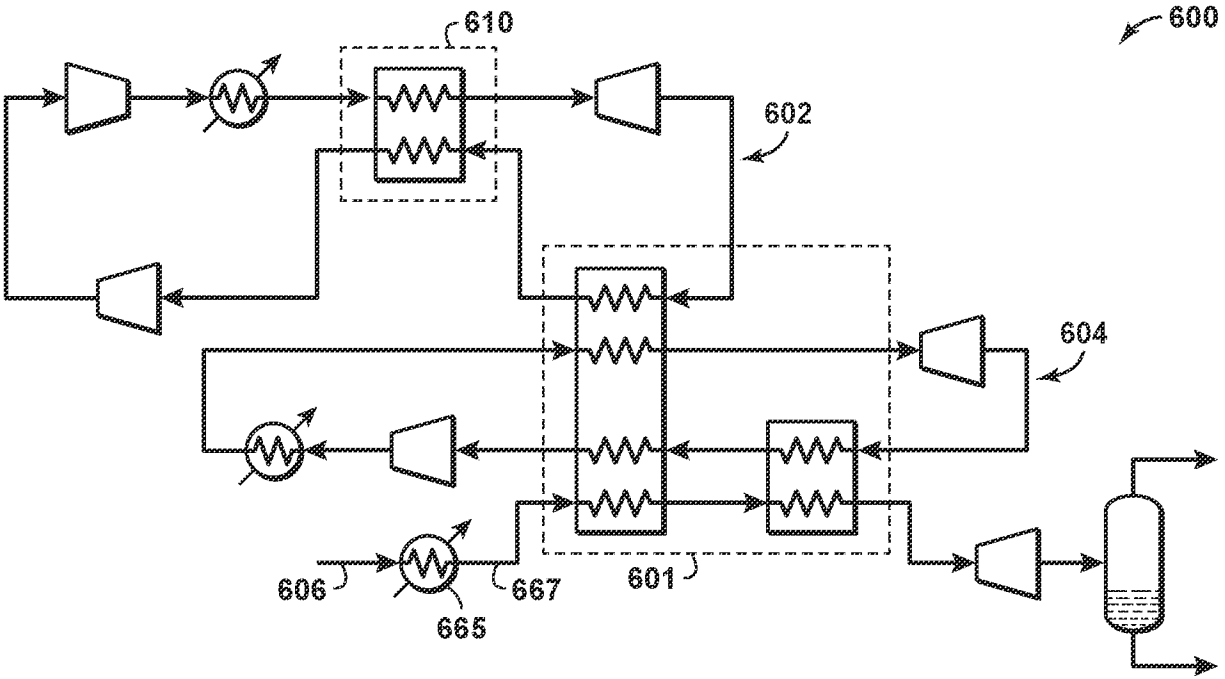
FIG. 6 is a schematic diagram of a system for LNG production according to disclosed aspects.

FIG. 6 is a schematic diagram that illustrates a liquefaction system 600 according to still another aspect of the disclosure. Liquefaction system 600 is similar to liquefaction system 300 and for the sake of brevity similarly depicted or numbered components may not be further described. Liquefaction system 600 includes a primary cooling loop 602 and a sub-cooling loop 604. Liquefaction system 600 also includes first and second heat exchanger zones 601, 610. Liquefaction system 600 includes the additional step of chilling, in an external cooling unit 665, the feed gas stream 606 to a temperature below the ambient temperature to produce a chilled gas stream 667. The chilled gas stream 667 is then directed to the first heat exchanger zone 601 as previously described. Chilling the feed gas as shown in FIG. 6 may be used to improve the overall efficiency of the liquefaction process and increase LNG production.

Figure 7:
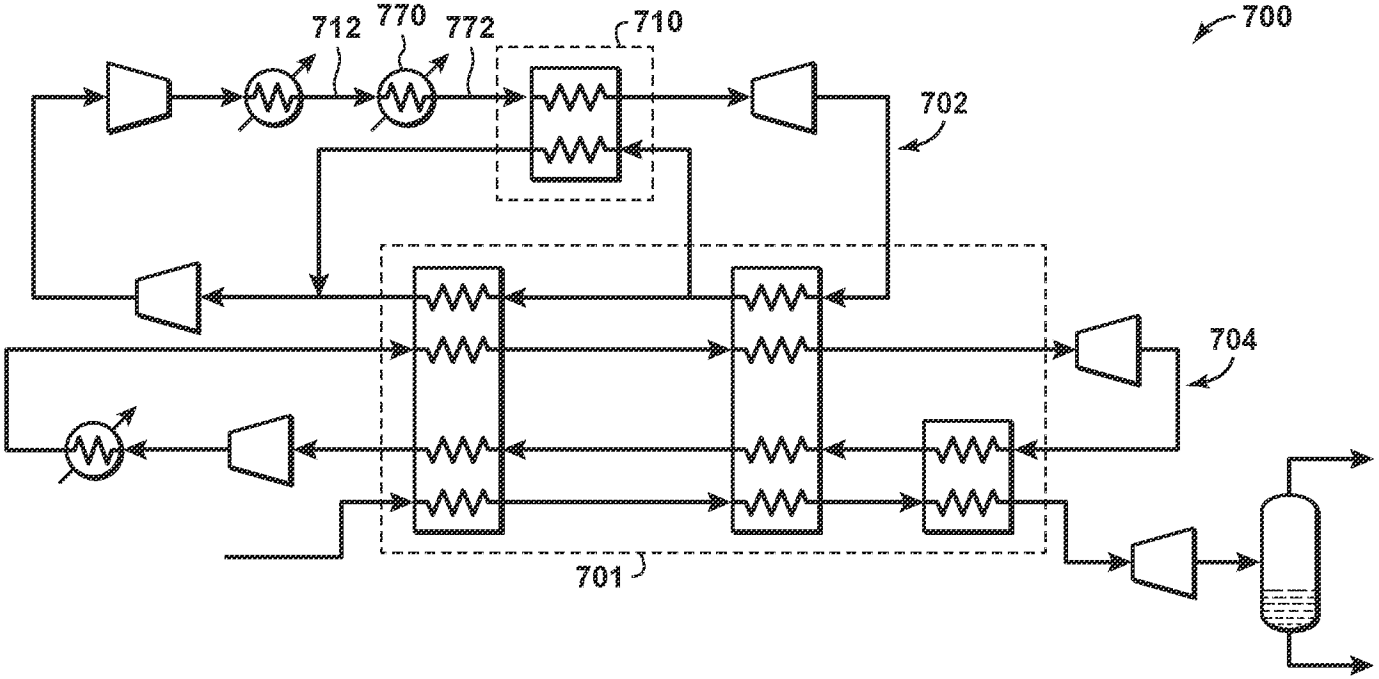
FIG. 7 is a schematic diagram of a system for LNG production according to disclosed aspects.

FIG. 7 is a schematic diagram that illustrates a liquefaction system 700 according to another aspect of the disclosure. Liquefaction system 700 is similar to liquefaction system 200 and for the sake of brevity similarly depicted or numbered components may not be further described. Liquefaction system 700 includes a primary cooling loop 702 and a sub-cooling loop 704. Liquefaction system 700 also includes first and second heat exchanger zones 701, 710. Liquefaction system 700 includes the additional step of chilling, using an external cooling unit 770, the compressed, cooled refrigerant 712 in the primary cooling loop 702 to a temperature below the ambient temperature, to thereby produce a compressed, chilled refrigerant 772. The compressed, chilled refrigerant 772 is then directed to the second heat exchanger zone 710 as previously described. Using an external cooling unit to further cool the compressed, cool refrigerant may be used to improve the overall efficiency of the process and increase LNG production.

Figure 8:
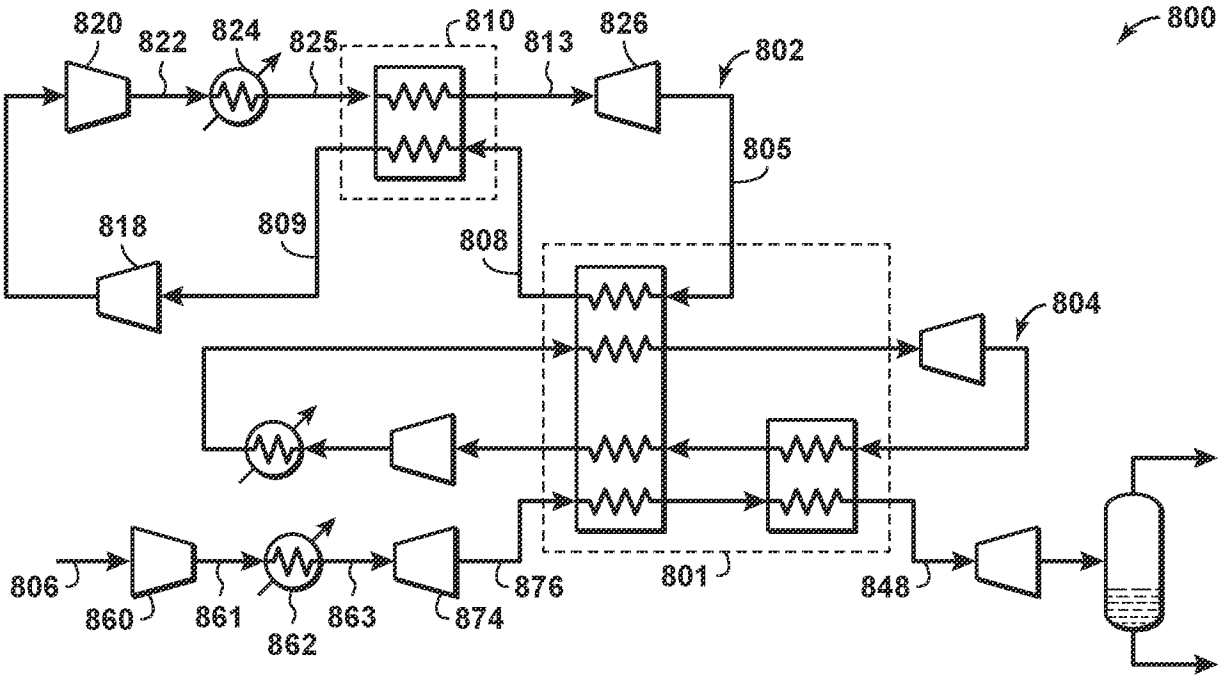
FIG. 8 is a schematic diagram of a system for LNG production according to disclosed aspects.

FIG. 8 is a schematic diagram that illustrates a liquefaction system 800 according to another aspect of the disclosure. Liquefaction system 800 is similar to liquefaction system 300 and for the sake of brevity similarly depicted or numbered components may not be further described. Liquefaction system 800 includes a primary cooling loop 802 and a sub-cooling loop 804. Liquefaction system 800 also includes first and second heat exchanger zones 801, 810. In liquefaction system 800, the feed gas stream 806 is compressed in a compressor 860 to a pressure of at least 1,500 psia to form a compressed gas stream 861. Using an external cooling unit 862, the compressed gas stream 861 is cooled by indirect heat exchange with an ambient temperature air or water to form a compressed, cooled gas stream 863. The compressed, cooled gas stream 863 is expanded in at least one work producing expander 874 to a pressure that is less than 2,000 psia but no greater than the pressure to which the gas stream was compressed, to thereby form a chilled gas stream 876. The chilled gas stream 876 is then directed to the first heat exchanger zone 801 where a primary cooling refrigerant and a sub-cooling refrigerant are used to liquefy the chilled gas stream as previously described.

The sub-cooling loop 804 is a closed refrigeration loop preferably charged with nitrogen as the sub-cooling refrigerant stream. Within the primary cooling loop 802, an expanded, cooled refrigerant stream 805 is directed to the first heat exchanger zone 801 where it exchanges heat with the chilled gas stream 876 to form a first warm refrigerant stream 808. The first warm refrigerant stream 808 is directed to the second heat exchanger zone 810 where it exchanges heat with a compressed, cooled refrigerant stream 825 to additionally cool the compressed, cooled refrigerant stream 825, thereby forming a second warm refrigerant stream 809 and a compressed, additionally cooled refrigerant stream 813. The first warm refrigerant stream 808 has a temperature that is cooler by at least 5° F., or more preferably, cooler by at least 10° F., or more preferably, cooler by at least 15° F., than the highest fluid temperature within the first heat exchanger zone 801. Using one or more compressors 818, 820, the second warm refrigerant stream 809 is compressed to a pressure greater than 1,500 psia, or more preferably, to a pressure of approximately 3,000 psia, to form a compressed refrigerant stream 822. The compressed refrigerant stream 822 is then cooled against an ambient cooling medium (air or water) in an external cooling unit 824 to produce the compressed, cooled refrigerant stream 825. After being directed through the second heat exchanger area 810, the compressed, additionally cooled refrigerant stream is near isentropically expanded in an expander 826 to produce the expanded, cooled refrigerant 805. The chilled gas stream 876 is liquefied and sub-cooled in the first heat exchanger zone to produce a sub-cooled gas stream 848, which is further processed as previously disclosed.

Figure 9:
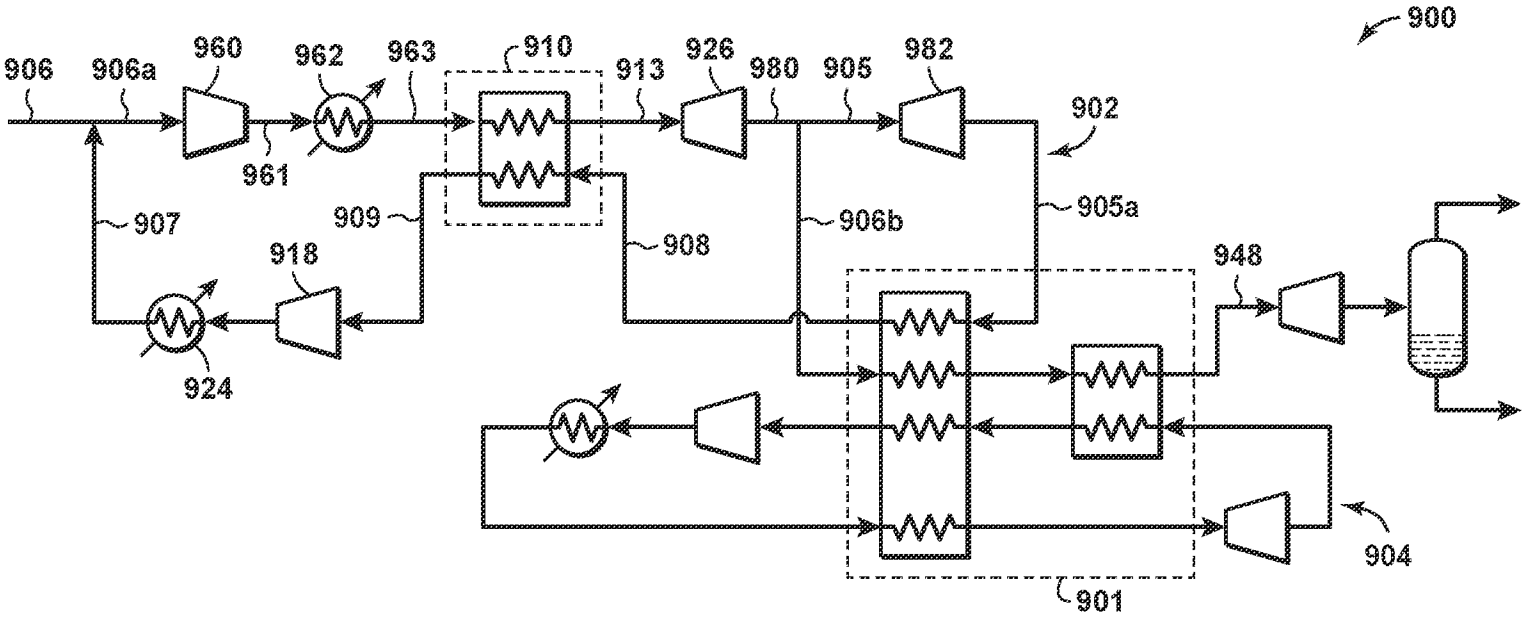
FIG. 9 is a schematic diagram of a system for LNG production according to disclosed aspects.

FIG. 9 is a schematic diagram that illustrates a liquefaction system 900 according to yet another aspect of the disclosure. Liquefaction system 900 contains similar structure and components with previously disclosed liquefaction systems and for the sake of brevity similarly depicted or numbered components may not be further described. Liquefaction system 900 includes a primary cooling loop 902 and a sub-cooling loop 904. Liquefaction system 900 also includes first and second heat exchanger zones 901, 910. In liquefaction system 900, the feed gas stream 906 is mixed with a refrigerant stream 907 to produce a second feed gas stream 906*a*. Using a compressor 960, the second feed gas stream 906*a* is compressed to a pressure greater than 1,500 psia, or more preferably, to a pressure of approximately 3,000 psia, to form a compressed second gas stream 961. Using an external cooling unit 962, the compressed second gas stream 961 is then cooled against an ambient cooling medium (air or water) to produce a compressed, cooled second gas stream 963. The compressed, cooled second gas stream 963 is directed to the second heat exchanger zone 910 where it exchanges heat with a first warm refrigerant stream 908, to produce a compressed, additionally cooled second gas stream 913 and a second warm refrigerant stream 909.

The compressed, additionally cooled second gas stream 913 is expanded in at least one work producing expander 926 to a pressure that is less than 2,000 psia, but no greater than the pressure to which the second gas stream 906*a* was compressed, to thereby form an expanded, cooled second gas stream 980. The expanded, cooled second gas stream 980 is separated into a first expanded refrigerant stream 905 and a chilled feed gas stream 906*b*. The first expanded refrigerant stream 905 may be near isentropically expanded using an expander 982 to form a second expanded refrigerant stream 905*a*. The chilled feed gas stream 906*b* is directed to the first heat exchanger zone 901 where a primary cooling refrigerant (i.e., the second expanded refrigerant stream 905*a*) and a sub-cooling refrigerant (from the sub-cooling loop 904) are used to liquefy the chilled gas stream 906*b*. The sub-cooling loop 904 may be a closed refrigeration loop, preferably charged with nitrogen as the sub-cooling refrigerant. Within the primary cooling loop 902, the second expanded refrigerant stream 905*a* is directed to the first heat exchanger zone 901 where it exchanges heat with the chilled feed gas stream 906*b* to form the first warm refrigerant stream 908. The first warm refrigerant stream 908 may have a temperature that is cooler by at least 5° F., or more preferably, cooler by at least 10° F., or more preferably, cooler by at least 15° F., than the highest fluid temperature within the first heat exchanger zone 901. The second warm refrigerant stream 909 is compressed in one or more compressors 918 and then cooled with an ambient cooling medium in an external cooling device 924 to produce the refrigerant stream 907. The chilled feed gas stream 906*b* is liquefied and sub-cooled in the first heat exchanger zone 901 to produce a sub-cooled gas stream 948, which is processed as previously described to form LNG.

Aspects of the disclosure illustrated in FIG. 9 demonstrate that the primary refrigerant stream may comprise part of the feed gas stream, which in a preferred aspect may be primarily or nearly all methane. Indeed, it may be advantageous for the refrigerant in the primary cooling loop of all the disclosed aspects (i.e., FIGS. 2 through 9) be comprised of at least 85% methane, or at least 90% methane, or at least 95% methane, or greater than 95% methane. This is because methane may be readily available in various parts of the disclosed processes, and the use of methane may eliminate the need to transport refrigerants to remote LNG processing locations. As a non-limiting example, the refrigerant in the primary cooling loop 202 in FIG. 2 may be taken through line 206*a* of the feed gas stream 206 if the feed gas is high enough in methane to meet the compositions as described above. Alternatively, part or all of a boil-off gas stream 259 from an LNG storage tank 257 may be used to supply refrigerant for the primary cooling loop 202. Furthermore, if the feed gas stream is sufficiently low in nitrogen, part or all of the end flash gas stream 258 (which would then be low in nitrogen) may be used to supply refrigerant for the primary cooling loop 202. Lastly, any combination of line 206*a*, boil-off gas stream 259, and end flash gas stream 258 may be used to provide or even occasionally replenish the refrigerant in the primary cooling loop 202.

Figure 10:
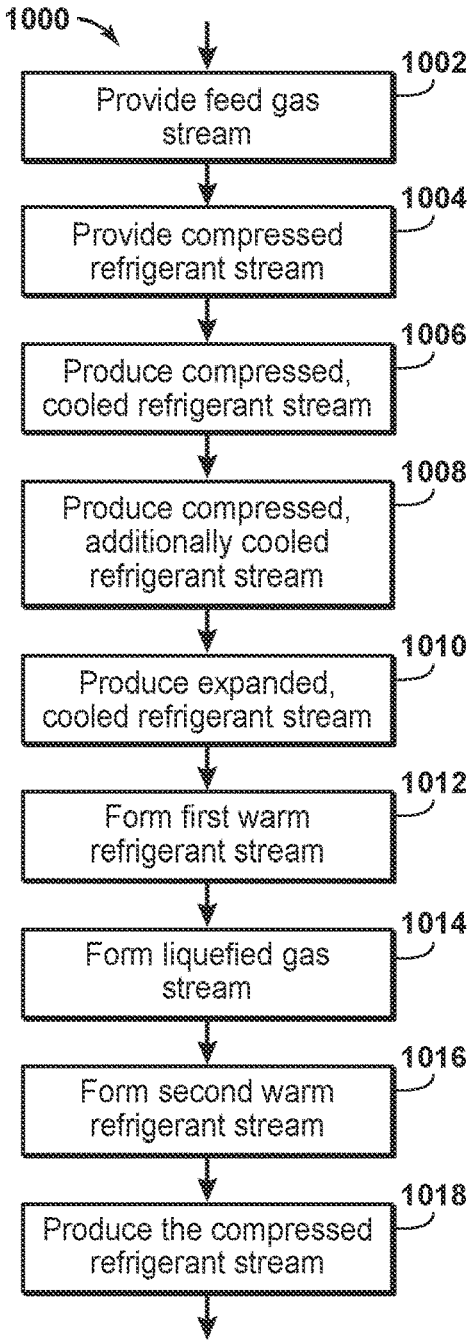
FIG. 10 is a flowchart of a method according to aspects of the disclosure.

FIG. 10 is a flowchart of a method 1000 for liquefying a feed gas stream rich in methane using a system having first and second heat exchanger zones, where the method comprises the following steps: 1002, providing the feed gas stream at a pressure less than 1,200 psia; 1004, providing a compressed refrigerant stream with a pressure greater than or equal to 1,500 psia; 1006, cooling the compressed refrigerant stream by indirect heat exchange with an ambient temperature air or water, to produce a compressed, cooled refrigerant stream; 1008, directing the compressed, cooled refrigerant stream to the second heat exchanger zone to additionally cool the compressed, cooled refrigerant stream below ambient temperature to produce a compressed, additionally cooled refrigerant stream; 1010, expanding the compressed, additionally cooled refrigerant stream in at least one work producing expander, thereby producing an expanded, cooled refrigerant stream; 1012, passing the expanded, cooled refrigerant stream through the first heat exchanger zone to form a first warm refrigerant stream, wherein the first warm refrigerant stream has a temperature that is cooler, by at least 5° F., than the highest fluid temperature within the first heat exchanger zone; 1014, passing the feed gas stream through the first heat exchanger zone to cool at least part of the feed gas stream by indirect heat exchange with the expanded, cooled refrigerant stream, thereby forming a liquefied gas stream; 1016 directing a least a portion of the first warm refrigerant stream to the second heat exchanger zone to cool by indirect heat exchange the compressed, cooled refrigerant stream, thereby forming a second warm refrigerant stream; and 1018, compressing the second warm refrigerant stream to produce the compressed refrigerant stream.

Figure 11:
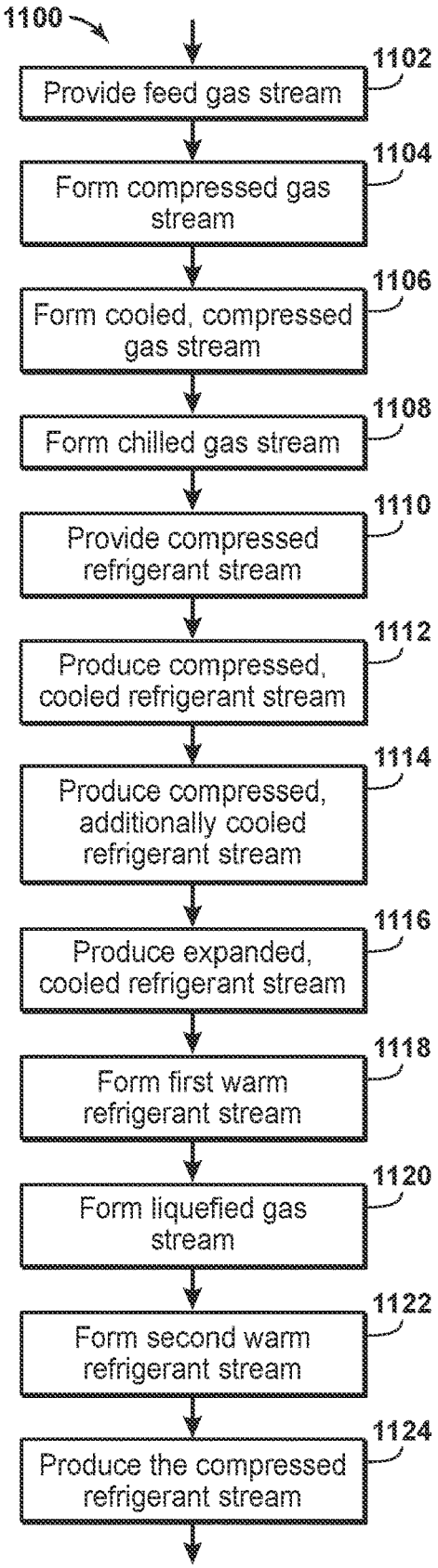
FIG. 11 is a flowchart of a method according to aspects of the disclosure.

FIG. 11 is a flowchart of a method 1100 for liquefying a feed gas stream rich in methane, where the method comprises the following steps: 1102, providing the feed gas stream at a pressure less than 1,200 psia; 1104, compressing the feed gas stream to a pressure of at least 1,500 psia to form a compressed gas stream; 1106, cooling the compressed gas stream by indirect heat exchange with an ambient temperature air or water, to form a cooled, compressed gas stream; 1108, expanding the cooled, compressed gas stream in at least one work producing expander to a pressure that is less than 2,000 psia and no greater than the pressure to which the gas stream was compressed, to thereby form a chilled gas stream; 1110, providing a compressed refrigerant stream with a pressure greater than or equal to 1,500 psia; 1112, cooling the compressed refrigerant stream by indirect heat exchange with an ambient temperature air or water, to produce a compressed, cooled refrigerant stream; 1114, directing the compressed, cooled refrigerant stream to a second heat exchanger zone, to additionally cool the compressed, cooled refrigerant stream below ambient temperature, to produce a compressed, additionally cooled refrigerant stream; 1116, expanding the compressed, additionally cooled refrigerant stream in at least one work producing expander, thereby producing an expanded, cooled refrigerant stream; 1118, passing the expanded, cooled refrigerant stream through a first heat exchanger zone to form a first warm refrigerant stream, whereby the first warm refrigerant stream has a temperature that is cooler, by at least 5° F., than the highest fluid temperature within the first heat exchanger zone; 1120, passing the chilled gas stream through the first heat exchanger zone to cool at least part of the chilled gas stream by indirect heat exchange with the expanded, cooled refrigerant, thereby forming a liquefied gas stream; 1122, directing the first warm refrigerant stream to the second heat exchanger zone to cool by indirect heat exchange the compressed, cooled refrigerant stream, thereby forming a second warm refrigerant stream; and 1124, compressing the second warm refrigerant stream to produce the compressed refrigerant stream.

Figure 12:
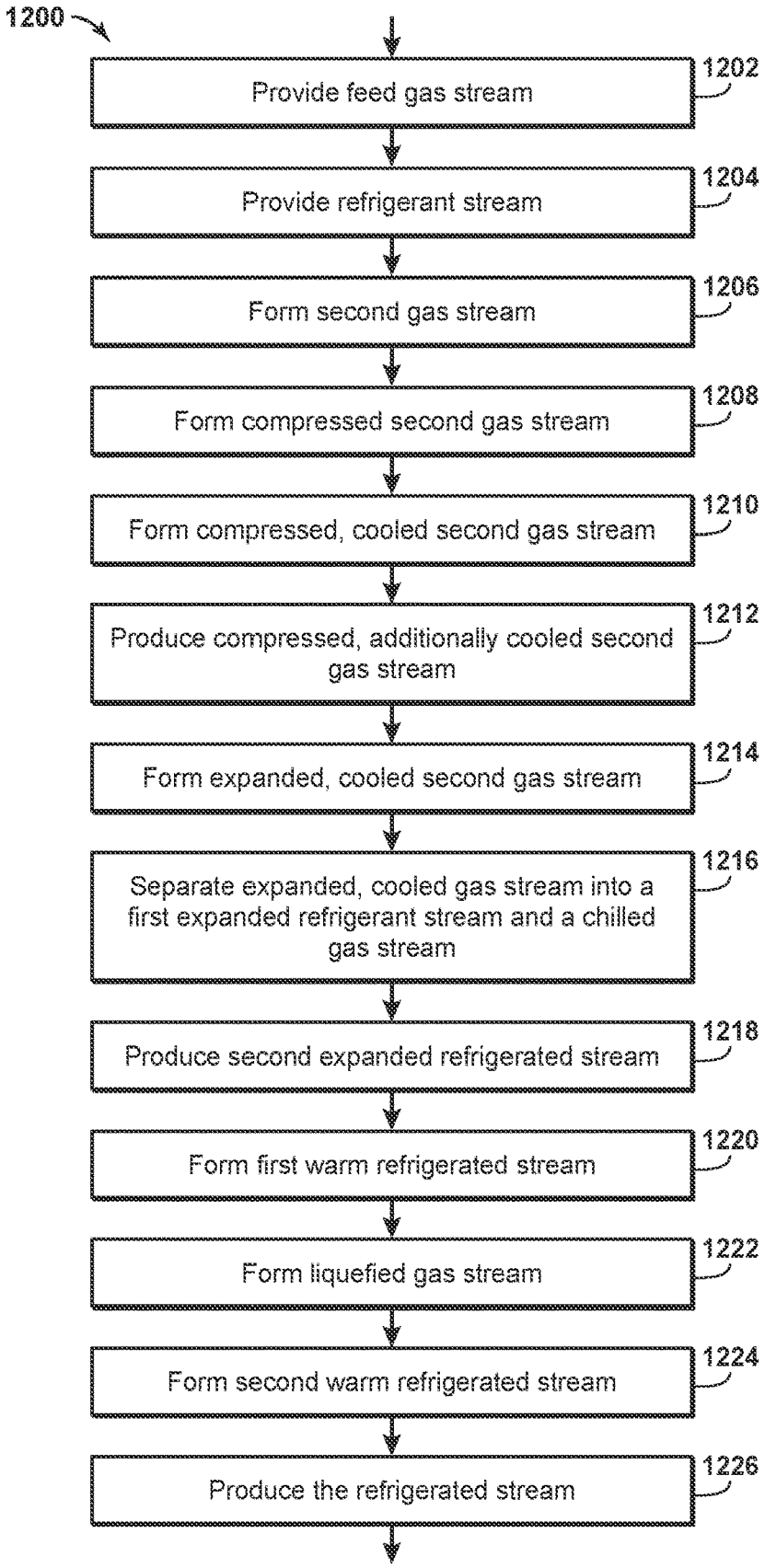
FIG. 12 is a flowchart of a method according to aspects of the disclosure.

FIG. 12 is a method 1200 for liquefying a feed gas stream rich in methane, where the method comprises the following steps: 1202, providing the feed gas stream at a pressure less than 1,200 psia; 1204, providing a refrigerant stream at near the same pressure of the feed gas stream; 1206, mixing the feed gas stream with the refrigerant stream to form a second gas stream; 1208, compressing the second gas stream to a pressure of at least 1,500 psia to form a compressed second gas stream; 1210, cooling the compressed second gas stream by indirect heat exchange with ambient temperature air or water, to form a compressed, cooled second gas stream; 1212, directing the compressed, cooled second gas stream to a second heat exchanger zone, to additionally cool the compressed, cooled second gas stream below ambient temperature, thereby producing a compressed, additionally cooled second gas stream; 1214, expanding the compressed, additionally cooled second gas stream in at least one work producing expander to a pressure that is less than 2,000 psia and no greater than the pressure to which the second gas stream was compressed, to thereby form an expanded, cooled second gas stream; 1216, separating the expanded, cooled second gas stream into a first expanded refrigerant stream and a chilled gas stream; 1218, expanding the first expanded refrigerant stream in at least one work producing expander, thereby producing a second expanded refrigerant stream; 1220, passing the second expanded refrigerant stream through a first heat exchanger zone to form a first warm refrigerant stream such that the first warm refrigerant stream has a temperature that is cooler, by at least 5° F., than the highest fluid temperature within the first heat exchanger zone; 1222, passing the chilled gas stream through the first heat exchanger zone to cool at least part of the chilled gas stream by indirect heat exchange with the second expanded refrigerant stream, thereby forming a liquefied gas stream; 1224, directing the first warm refrigerant stream to the second heat exchanger zone to cool by indirect heat exchange the compressed, cooled second gas stream, thereby forming a second warm refrigerant stream; and 1226, compressing the second warm refrigerant stream to produce the refrigerant stream.

The steps depicted in FIGS. 10-12 are provided for illustrative purposes only and a particular step may not be required to perform the disclosed methodology. Moreover, FIGS. 10-12 may not illustrate all the steps that may be performed. The claims, and only the claims, define the disclosed system and methodology.

The aspects described herein have several advantages over known technologies. For example, the described technology may greatly reduce the size and cost of systems that treat sour natural gas.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for liquefying a feed gas stream rich in methane, comprising:

providing the feed gas stream at a pressure less than 1,200 psia;

compressing the feed gas stream to a pressure of at least 1,500 psia to form a compressed gas stream;

cooling the compressed gas stream by indirect heat exchange with an ambient temperature air or water to form a cooled, compressed gas stream;

expanding the cooled, compressed gas stream in at least one first work producing expander to a pressure that is less than 2,000 psia and no greater than the pressure to which the feed gas stream was compressed to form a chilled gas stream;

passing the chilled gas stream to a first heat exchanger zone downstream from the at least one first work producing expander, the first heat exchanger zone comprising a first main heat exchanger, a second main heat exchanger, and a sub-cooling heat exchanger sequentially downstream from the at least one first work producing expander;

providing a compressed refrigerant stream with a pressure greater than or equal to 1,500 psia;

cooling the compressed refrigerant stream by indirect heat exchange with an ambient temperature air or water to produce a compressed, cooled refrigerant stream;

directing the compressed, cooled refrigerant stream to a second heat exchanger zone comprising at least one heat exchanger to additionally cool the compressed, cooled refrigerant stream below ambient temperature to produce a compressed, additionally cooled refrigerant stream;

expanding the compressed, additionally cooled refrigerant stream in at least one second work producing expander to produce an expanded, cooled refrigerant stream;

passing the expanded, cooled refrigerant stream through the second main heat exchanger of the first heat exchanger zone but not the sub-cooling heat exchanger to form a first warm refrigerant stream having a temperature that is cooler, by at least 5° F., than a highest fluid temperature within the first heat exchanger zone;

cooling at least part of the chilled gas stream in the first heat exchanger zone by indirect heat exchange with the expanded, cooled refrigerant stream to form a liquefied gas stream;

wherein the chilled gas stream passes sequentially through the first main heat exchanger, the second main heat exchanger, and the sub-cooling heat exchanger to form the liquefied gas stream, and neither the chilled gas stream nor the liquefied gas stream are passed through the second heat exchanger zone;

directing a first portion of the first warm refrigerant stream to the second heat exchanger zone to cool by indirect heat exchange the compressed, cooled refrigerant stream to form a second warm refrigerant stream;

directing a second portion of the first warm refrigerant stream to the first main heat exchanger, such that the second portion of the first warm refrigerant stream bypasses the second heat exchanger zone, to form a third warm refrigerant stream exiting the first main heat exchanger;

combining the second warm refrigerant stream and the third warm refrigerant stream to produce a fourth warm refrigerant stream; and compressing the fourth warm refrigerant stream to produce the compressed refrigerant stream.

2. The method of claim 1, wherein the feed gas stream is compressed to a pressure equal to or greater than 2,000 psia and equal to or less than 3,500 psia.

3. The method of claim 1, wherein the compressed refrigerant stream is produced using at least two serially arranged compressors.

4. The method of claim 1, wherein the first heat exchanger zone and the second heat exchanger zone contain different types of heat exchangers.

5. The method of claim 4, wherein the at least one heat exchanger of the second heat exchanger zone has a design pressure of at least 1,500 psia, and the first and second main heat exchangers and the sub-cooling heat exchanger of the first heat exchanger zone have design pressures of less than 1,500 psia.

6. A system for liquefying a feed gas stream rich in methane and having a pressure less than 1,200 psia, comprising:

at least one first compressor for compressing the feed gas stream to a pressure of at least 1,500 psia to form a compressed gas stream;

a cooler for cooling the compressed gas stream by indirect heat exchange with an ambient temperature air or water to form a cooled, compressed gas stream;

at least one first work producing expander for expanding the cooled, compressed gas stream to a pressure that is less than 2,000 psia and no greater than the pressure to which the feed gas stream was compressed to form a chilled gas stream;

a first heat exchanger zone downstream from the at least one first work producing expander for receiving the chilled gas stream therefrom, the first heat exchanger zone comprising a first main heat exchanger, a second main heat exchanger, and a sub-cooling heat exchanger sequentially downstream from the at least one first work producing expander;

a compressed refrigerant stream with a pressure greater than or equal to 1,500 psia;

a refrigerant cooler for cooling the compressed refrigerant stream by indirect heat exchange with an ambient temperature air or water to produce a compressed, cooled refrigerant stream;

wherein the compressed, cooled refrigerant stream is directed through a second heat exchanger zone comprising at least one heat exchanger to be additionally cooled below ambient temperature to produce a compressed, additionally cooled refrigerant stream;

at least one second work producing expander for expanding the compressed, additionally cooled refrigerant stream to produce an expanded, cooled refrigerant stream;

wherein the expanded, cooled refrigerant stream is passed through the second main heat exchanger of the first heat exchanger zone but not the sub-cooling heat exchanger to form a first warm refrigerant stream having a temperature that is cooler, by at least 5° F., than a highest fluid temperature within the first heat exchanger zone;

wherein the chilled gas stream is passed sequentially through the first main heat exchanger, the second main heat exchanger, and the sub-cooling heat exchanger to cool at least part of the chilled gas stream by indirect heat exchange with the expanded, cooled refrigerant stream to form a liquefied gas stream, and neither the chilled gas stream nor the liquefied gas stream are passed through the second heat exchanger zone; and wherein a first portion of the first warm refrigerant stream is directed to the second heat exchanger zone to cool by indirect heat exchange the compressed, cooled refrigerant stream to form a second warm refrigerant stream, a second portion of the first warm refrigerant stream bypasses the second heat exchanger zone and is directed to the first main heat exchanger to form a third warm refrigerant stream exiting the first main heat exchanger, and the second warm refrigerant stream and the third warm refrigerant stream are combined to produce a fourth warm refrigerant stream; and at least one second compressor for compressing the fourth warm refrigerant stream to produce the compressed refrigerant stream.

7. The system of claim 6, wherein the feed gas stream is compressed to a pressure equal to or greater than 2,000 psia and equal to or less than 3,500 psia.

8. The system of claim 6, wherein the compressed refrigerant stream is produced using at least two serially arranged compressors.

9. The system of claim 6, wherein the first heat exchanger zone and the second heat exchanger zone contain different types of heat exchangers.

10. The system of claim 9, wherein the at least one heat exchanger of the second heat exchanger zone has a design pressure of at least 1,500 psia, and the first and second main heat exchangers and the sub-cooling heat exchanger of the first heat exchanger zone have design pressures of less than 1,500 psia.

* * * * *